US006302604B1

(12) United States Patent
Bryant et al.

(10) Patent No.: US 6,302,604 B1
(45) Date of Patent: Oct. 16, 2001

(54) RACK AND PINION MEDIUM ROLL SUPPORT

(75) Inventors: Caleb Bryant, Moorpark; Bob Brashear, Simi Valley, both of CA (US)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 09/477,996

(22) Filed: Jan. 5, 2000

(51) Int. Cl.[7] ..... B41J 15/02

(52) U.S. Cl. ..... 400/619; 400/693; 101/288; 242/578.2; 242/597.5

(58) Field of Search ..... 101/228, 288, 101/407.1; 242/578.2, 596, 596.1, 596.7, 597, 597.5, 597.8, 599.1, 599.2; 400/613, 613.1, 619, 693

(56) References Cited

U.S. PATENT DOCUMENTS 5,486,259 * 1/1996 Goodwin et al. ..... 156/384
5,813,343 * 9/1998 Harb ..... 101/407.1
5,833,377 * 11/1998 Keller et al. ..... 400/208

* cited by examiner

*Primary Examiner*—Ren Yan
(74) *Attorney, Agent, or Firm*—Fulbright & Jaworski L.L.P.

(57) ABSTRACT

A rack and pinion medium roll support includes a support holder, a generally circular shape support shaft perpendicularly coupled to the support holder, and a rack and pinion mechanism, said rack and pinion mechanism comprising a pinion rotatably coupled to the support holder, an inner adjustable lever having an inner toothed rack meshed with the pinion, and an outer adjustable lever having an outer toothed rack meshed with the pinion at diametrically opposite end of the inner toothed rack of the inner adjustable lever, the inner adjustable lever being slidably coupled to the support shaft at an inner end and the outer adjustable lever being slidably coupled to the support shaft at an outer end, wherein the pinion is adapted to move the inner adjustable lever and the outer adjustable lever with approximately equal distance relative to each other for center adjusting a medium roll mounted on the support shaft between the inner adjustable lever and the outer adjustable lever.

17 Claims, 5 Drawing Sheets

RACK AND PINION MEDIUM ROLL SUPPORT

FIELD OF THE INVENTION

Figure 1:
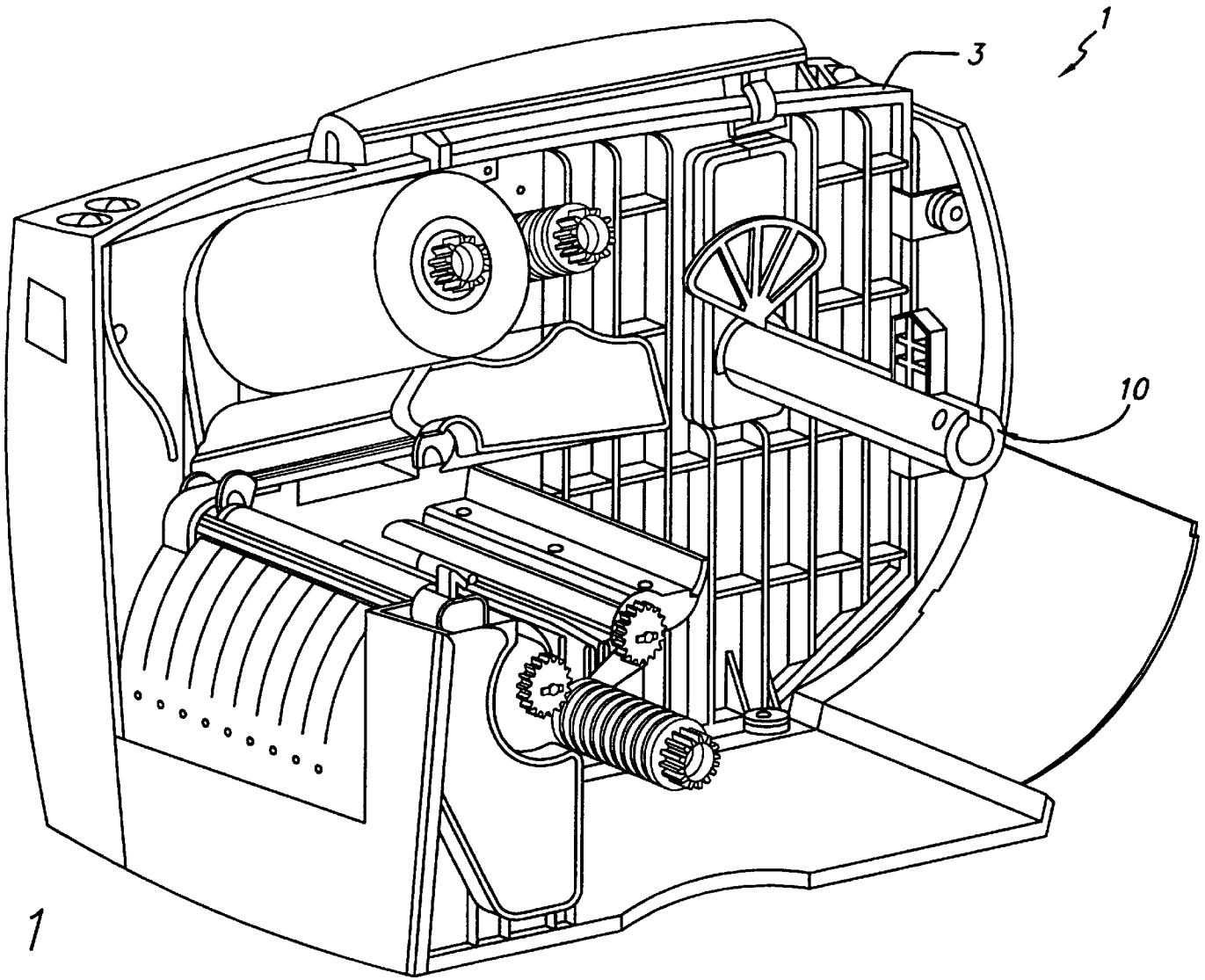

The present invention relates generally to an image forming device and, more particularly, to a rack and pinion medium roll support having a rack and pinion mechanism adapted to be incorporated into the image forming device for center justifying printing media fed into the image forming device.

BACKGROUND OF THE INVENTION

Various types of medium roll support devices of have been devised for conventional printers to accommodate different types or sizes of printing medium rolls to be mounted thereon in the conventional printers. A typical conventional printer has a first and second roll support holders respectively positioned at opposite ends of a compartment inside the conventional printer. For example, the U.S. Patent "Printing Media Roll Mounting and Positioning Mechanism" (U.S. Pat. No. 5,813,343) discloses such an arrangement of the first and second roll support holders respectively coupled to a support frame of the conventional printer defining the compartment inside the conventional printer. A conventional printing medium roll often includes a continuous printing medium strip wound on a cylindric tubular core. Correspondingly, the first roll support holder often has a support head adapted to receive and support the printing medium roll by inserting a first end of the tubular core onto a stair-like stepped extrusion on the support head of the first roll support holder. Similarly, the second roll support holder also has a support head adapted to receive and support a second end, opposite to the first, of the tubular core onto a stair-like stepped extrusion on the support head of the second roll support holder. The first and second roll support holders are vertically coupled to the printer having their respective support heads positioned at the top. Thus, the printing medium roll will be horizontally overhung inside the compartment of the printer by being supported by the first and second roll support holders at both ends.

Ordinarily, the first and second roll support holders of the conventional printer are coupled to each other through a connecting mechanism. The connecting mechanism includes a pair of substantially parallel first and second toothed racks respectively coupled to the first and second roll support holders at their respective bottom ends. The first and second toothed racks are spaced apart with each other in parallel and are further coupled to each other through a pinion positioned therein between. Teeth of the first and second toothed racks are respectively located at one side of the first and second toothed racks and are facing each other after the first and second toothed racks are coupled to the first and second roll support holders respectively. Moreover, teeth of the pinion mesh with teeth of the first and second toothed racks at diametrically opposite ends of the pinion, whereby the pinion will direct the first and second roll support holders to move toward each other at a first rotational direction and will direct the first and second roll support holders to move apart from each other at a second rotational direction, opposite to the first. The rotation of the pinion may be controlled manually by urging either the first or the second roll support holders inward or outward so as to pull them toward or away from each other respectively. When the first roll support holder is urged inward toward the second roll support holder, the first toothed rack will urge the pinion to rotate at the first rotational direction. Since the teeth of the pinion are meshing with the teeth of the second toothed rack at the diametrically opposite end, the pinion will move the second roll support holder inward through the rotation of the pinion at the first rotational direction. Conversely, when the first roll support holder is urged outward away from the second roll support holder, the pinion will be forced to rotate at the second rotational direction, opposite to the first, thereby urging the second roll support holder to move outward away from the first roll support holder. In addition, the pinion is positioned at approximately the center between the first and second roll support holders after mounted. As a consequence, through the above-mentioned arrangement of the connecting mechanism, the conventional printer could substantially center-justify the printing medium roll that is mounted on the first and second roll support holders with respectto a center line defined by the first and second roll support holders. Alternatively, the rotation of the pinion may be manually controlled by a rotating mechanism coupled to the pinion for directing the pinion to rotate in any desirable rotational direction, or it may be automatically controlled by a drive motor coupled to the conventional printer.

The pinion of the connecting mechanism of the conventional printer is often coupled to the support frame at a bottom side through a spindle. The spindle is positioned at approximately a center point on the support frame between the first and second roll support holders. The pinion has a center hole adapted to allow the spindle to thread through therein, thereby the pinion could rotate freely at opposite rotational directions about the spindle. The conventional printer may also include a spring coupled to one of the toothed racks and to the support frame, as shown in the '343 patent. The spring is designed to cause the first and second roll support holders to have the tendency to move toward each other so that the first and second roll support holders may hold the mounted printing medium roll firmly in between.

Although the conventional printer provides a mounting and positioning mechanism for printing media, many unresolved drawbacks remain to be overcome by further improvements. Specifically, incorporating the first and second roll support holders inside the printer would inevitably increase the lateral and/or vertical dimensions of the printer.

Furthermore, since the support heads of the first and second roll support holders respectively often includes a multiple-step extrusion, this design will further increase the lateral dimension of the conventional printer. As a result, it's particularly disadvantageous for a small portable printer to incorporate both the first and second roll support holders. In addition, having a complex medium roll support device as disclosed above, including the first and second support holders and the connecting mechanism therein between, will also increase the manufacturing costs of the conventional printer. This cost increase is very undesirable in this highly competitive market.

SUMMARY OF THE INVENTION

In a preferred embodiment, the rack and pinion medium roll support of the present invention comprises a roll support holder, a generally circular support shaft securely coupled to the roll support holder at one end, and a rack and pinion mechanism positioned partially inside the support shaft and the roll support holder, wherein the rack and pinion mechanism has left and right levers slidably positioned on said support shaft at opposite sides respectively for center-justifying the printing medium roll mounted on the support shaft of the rack and pinion medium roll support according to the present invention.

The foregoing and additional features and advantages of this present invention will become apparent by way of non-limitative examples shown in the accompanying drawings and detailed description that follow. In the figures and written description, numerals indicate the various features of the invention, like numerals referring to like features throughout for both the drawing figures and the written description.

BRIEF DESCRIPTION OF THE INVENTION

FIG. 1 is a perspective view of a cut-away printer having a rack and pinion medium roll support according to the present invention incorporated therein.

Figure 2A:
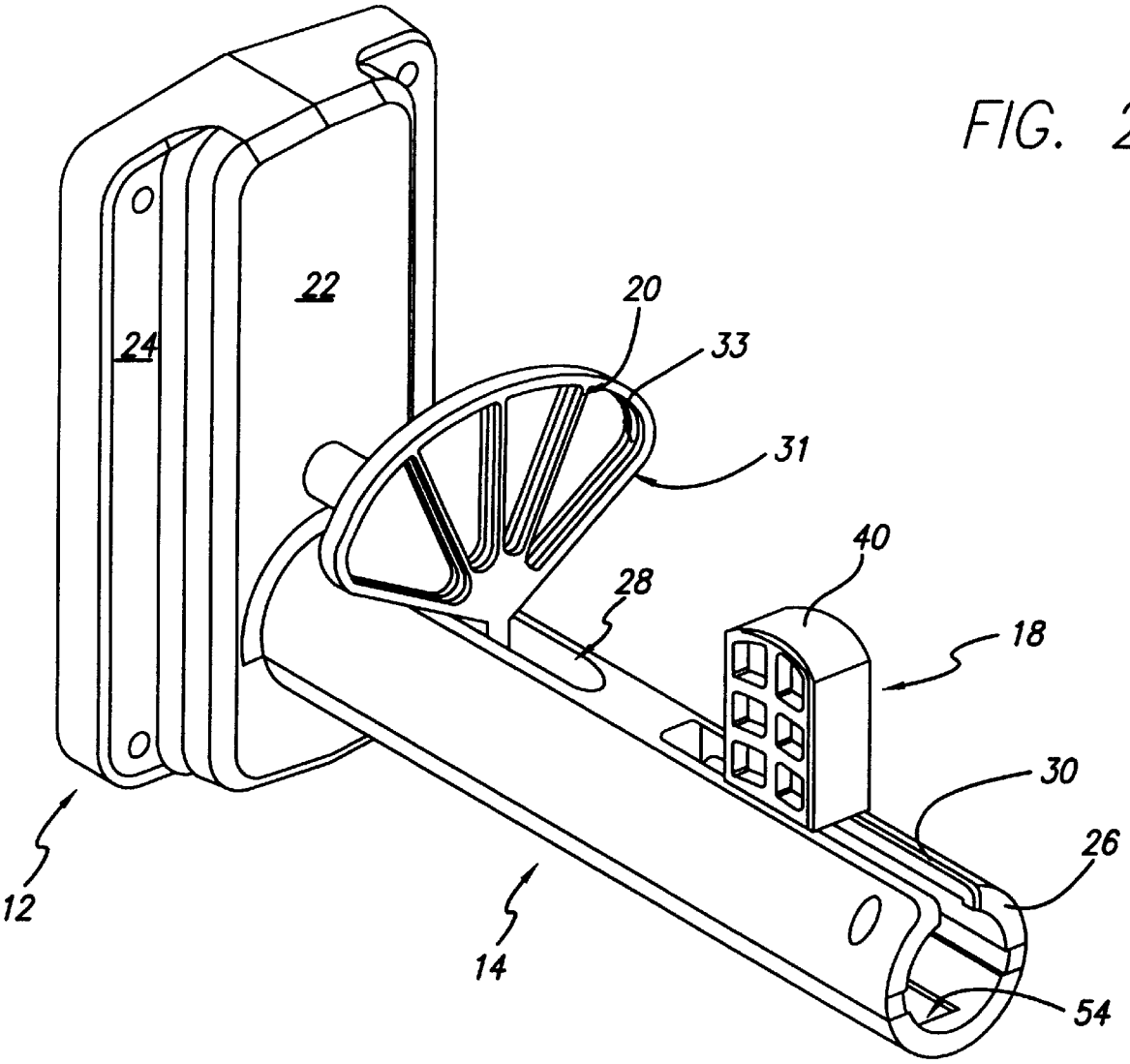

FIG. 2*a* is a detailed perspective view of the rack and pinion medium roll support in FIG. 1 having a left and right levers respectively positioned at opposite sides near the center of a support shaft.

Figure 2B:
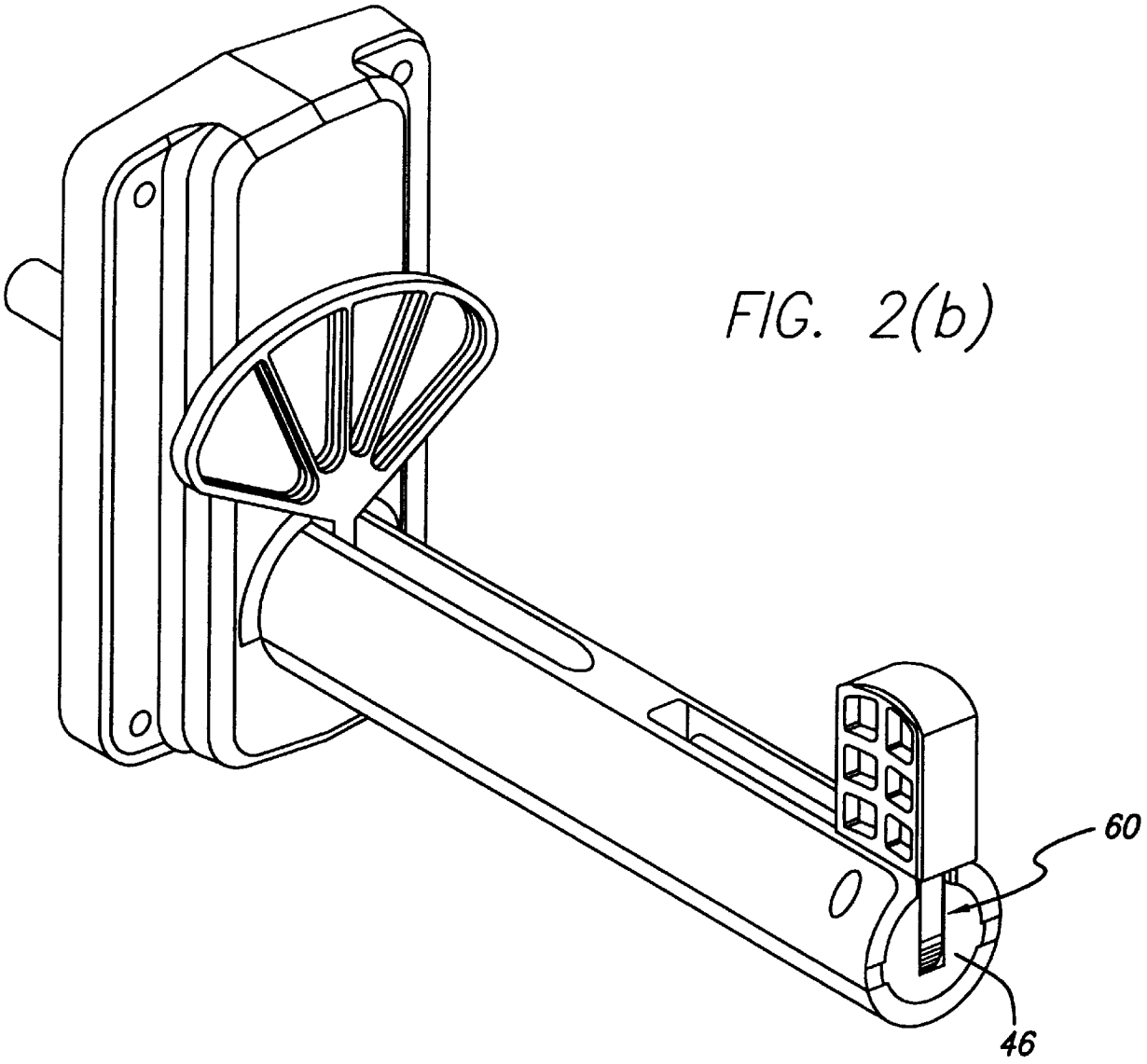

FIG. 2*b* is a detailed perspective view of the rack and pinion medium roll support in FIG. 1 having the left and right levers respectively positioned at their far left and far right positions on the support shaft.

Figure 2C:
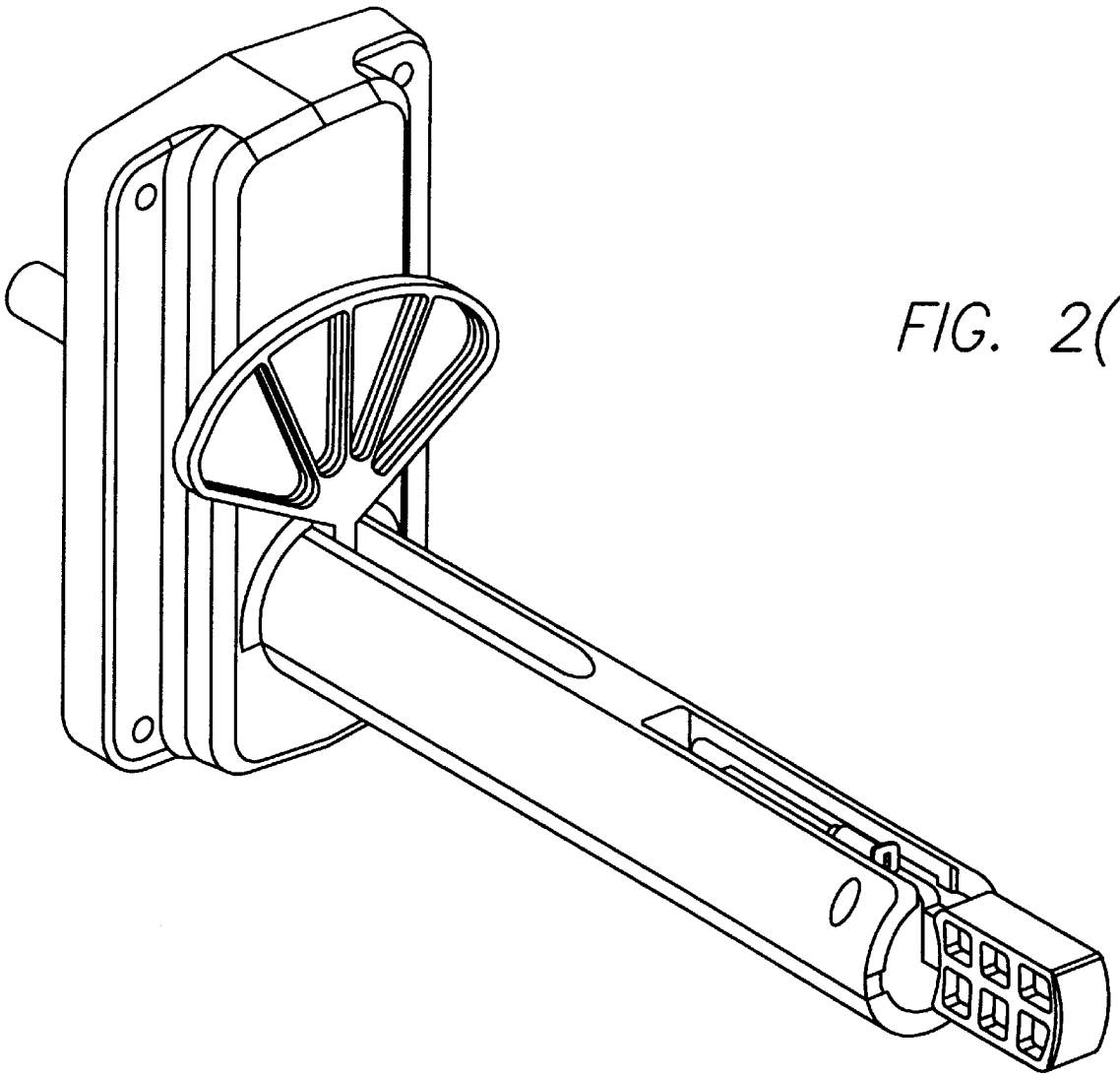

FIG. 2*c* is a detailed perspective view of the rack and pinion medium roll support in FIG. 1 having the right lever at a horizontal position.

Figure 3A:
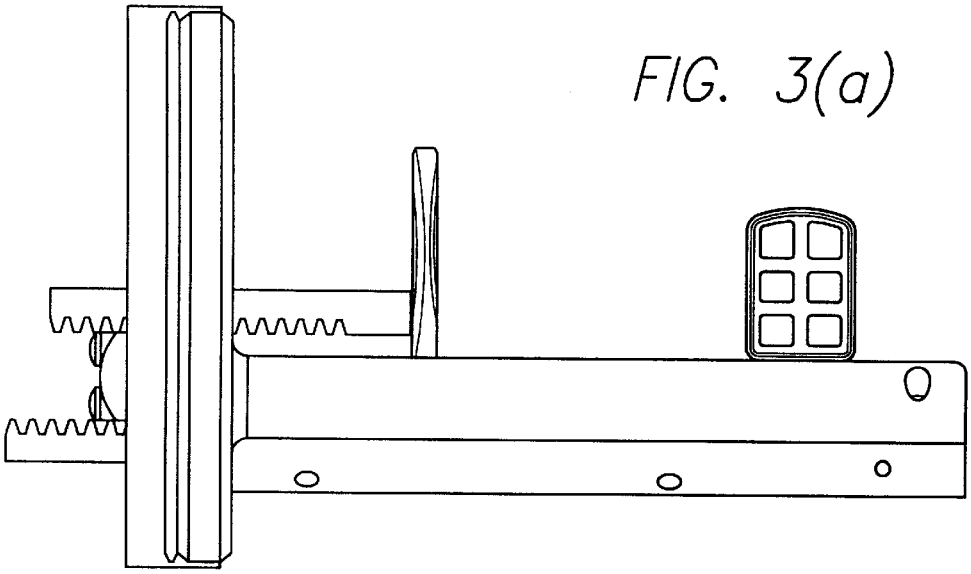

FIG. 3*a* is a side view of the rack and pinion medium roll support in FIG. 2*a*.

Figure 3B:
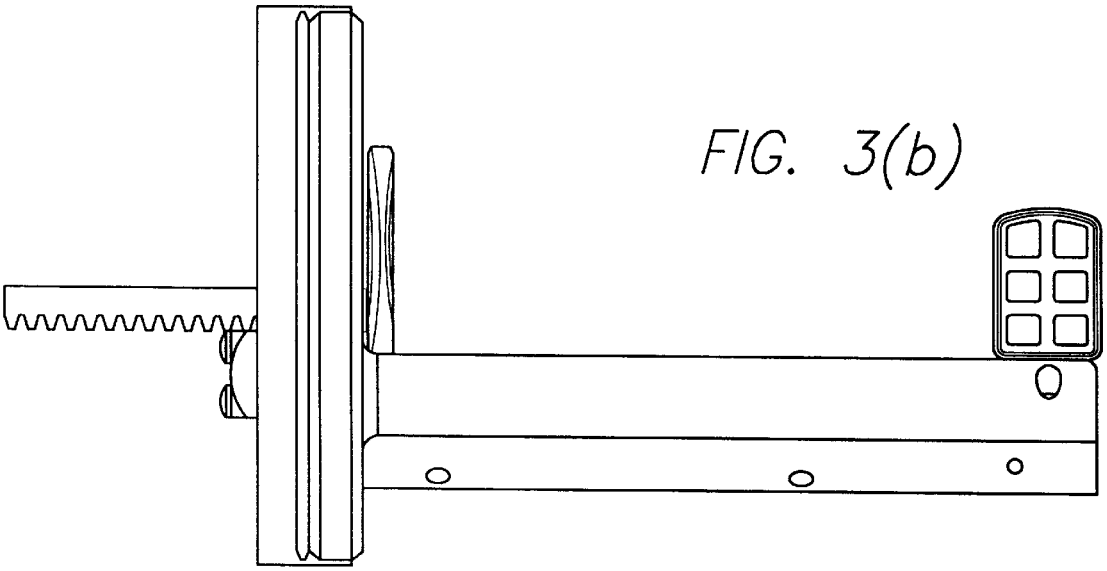

FIG. 3*b* is a side view of the rack and pinion medium roll support in FIG. 2*b*.

Figure 4:
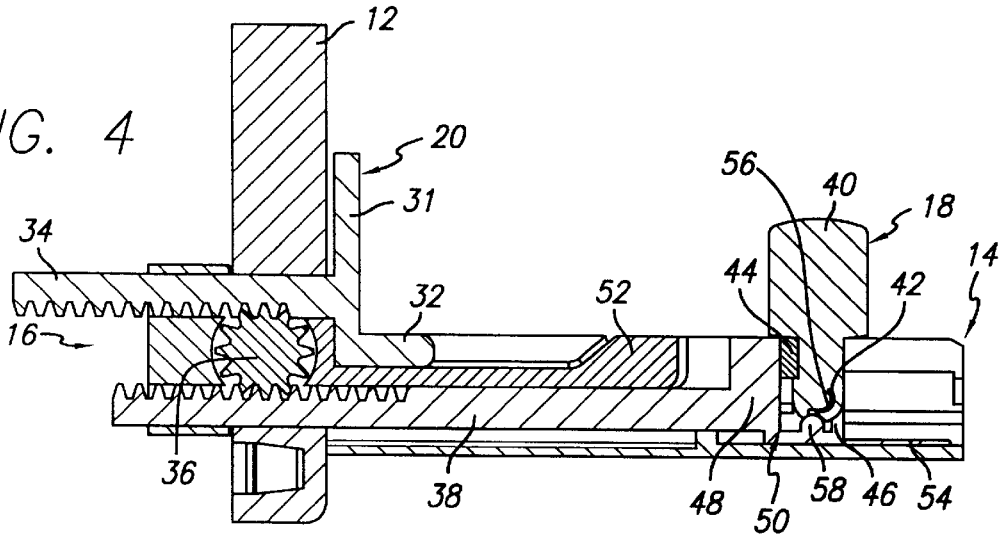

FIG. 4 is a cross-sectional view of the rack and pinion medium roll support.

DETAILED DESCRIPTION OF THE INVENTION

FIG. 1 shows a rack and pinion medium roll support 10 according to the present invention being incorporated into a printer 1. The printer 1 has a support frame 3 defining an internal compartment for housing components of the printer 1, including the rack and pinion medium roll support 10. The internal compartment normally is also sufficiently large to house a printing medium roll to be mounted on the rack and pinion medium roll support 10. The rack and pinion medium roll support 10 is securely coupled to the support frame 3 at a first inner side and near a rear end of the printer 1, as shown in FIG. 1.

Referring to FIG. 2*a,* the rack and pinion medium roll support 10 has a support shaft 14 securely coupled to a shaft holder 12 at a first end, thereby the support shaft is substantially perpendicular to the shaft holder 12. In the preferred embodiment, the support shaft 14 is coupled to the shaft holder 12 by fixing means, such as screws, threaded into the support shaft 14 from the back side of the shaft holder 12. In alternative embodiments, the support shaft 14 may be glued to or be screwed into the shaft holder 12. The shaft holder 12 has a stepped feature on a front side facing the support shaft 14. A back side of the shaft holder 12 has a substantially reversed stepped feature to the front side such that the back side of the shaft holder 12 has a stepped hollow recess for housing parts of a rack and pinion mechanism 16 of the present invention, as will be explained in detail in the following paragraphs. In the preferred embodiment, the front side of the shaft holder 12 has a generally rectangular top step 22 fixedly positioned on top of a generally rectangular base step 24. The top step 22 has an opening near its bottom end, wherein the support shaft 14 is securely coupled to the top step 22 surrounding the opening. The top step 22 is of approximately 1.4 inches wide by 3.77 inches long and 0.35 inches high, and the base step 24 is of approximately 2.4 inches wide by 3.77 inches long and 0.35 inches high. A hole is situated at each of the four corners of the base step 24. These four holes are respectively adapted to receive a fixing means, such as a screw, to be threaded through therein for mounting the rack and pinion medium roll support 10 securely on the support frame 3 of the printer 1. FIG. 1 also shows the shaft holder 12 being coupled to the support frame 3 of the printer 1 at a upper half of the internal compartment so that the support shaft 14 is substantially cantilevered inside the internal compartment of the printer 1 defined by the support frame 3. In the preferred embodiment, the shaft holder 12 is molded of plastic materials, but other suitable materials may be used to make the shaft holder 12.

The body of the support shaft 14 is formed by a generally tubular shape body wall 26 having a pair of substantially concentric outer and inner surfaces. The body wall 26 has an elongated and substantially circular-tube shape, wherein its outer diameter is of approximately 0.98 inches and its inner diameter is of approximately 0.63 inches. A surface portion of the body wall 26 is removed throughout the elongated body of the support shaft 14, as shown in FIG. 2*a,* thereby a flat top portion of the support shaft 14 will face up when the support shaft 14 is mounted on the shaft holder 12. Moreover, the support shaft 14 also has an inner and an outer elongated opening slots 28, 30 respectively positioned within the flat surface portion of the body wall 26 and extending from opposite ends of the body wall 26 toward the center of the support shaft 14 by approximately 2 inches. The inner and outer opening slots 28, 30 respectively have a width of approximately 0.22 inches and are formed by removing materials of the body wall 26 at their respective locations.

The rack and pinion mechanism 16 of the present invention comprises a pair of levers 20, 18, a rotatable pinion 36, and a pair of toothed racks 34, 38 respectively coupled to the pair of levers 20, 18. The pair of levers 20, 18 includes an inner lever 20 and an outer lever 18, wherein the inner lever 20 is slidably positioned on the inner opening slot 28 near the shaft holder 12 and the outer lever 18 is slidably positioned on the outer opening slot 30 away from the shaft holder 12. The inner lever 20 has a substantially fan shaped top section 31 and an L-shaped extrusion 32 coupled to the stem of the top section 31, as shown in FIG. 4. In the preferred embodiment, the inner lever 20 has five radial spokes 33 on the top section 31 extending from the root of the L-shaped extrusion 32 upward, and a circumferential perimeter connected to the outer ends of each of the five spokes 33. The radial spokes 33 are substantially positioned in a same plane and are approximately one inch long, respectively. Moreover, the two outmost radial spokes (far left and far right) of the inner lever 20 together form an inner angle of approximately 160° therein between.

Referring to FIG. 4, the L-shaped extrusion 32 of the inner lever 20 is inserted into the inner opening slot 28. The bottom of the L-shaped extrusion 32 is approximately 0.8 inches long extending from the top section 31 toward the center of the support shaft 14. As shown in FIG. 4, a lever support 52 is positioned under the inner opening slot 28 within the support shaft 14. The lever support 52 has a stepped top surface near a first end to receive the bottom portion of the L-shaped extrusion 32 and has a slant top surface near a second end, whereby the L-shaped extrusion 32 can be slidably positioned on the top surface of the lever support 52 between these two ends. In the preferred embodiment, the lever support 52 is tightly trapped between an inner lever rack 34 and an outer lever rack 38 inside the support shaft 14, as shown in FIG. 4. In alternative embodiments, the lever support 52 can be securely coupled to the support shaft 14 by fixing means, such as screws, or by gluing to the support shaft 14. In addition, the first end of the lever support 52 is positioned next to the pinion 36 and is curved to have a diameter slightly larger than the diameter of the pinion 36. The second end of the lever support 52 is located at approximately the center of the support shaft 14. The depth of the stepped top surface of the lever support 52 is approximately 0.25 inches long, which is substantially sufficient to house the bottom of the L-shaped extrusion 32 within the inner opening slot 28.

The pair of toothed racks includes the inner lever rack 34 and the outer lever rack 38. The inner lever rack 34 is perpendicularly coupled to the inner lever 20 at the stem of the spokes 33. The inner lever rack 34 has an elongated shape of approximately 2.46 inches long and extends from the stem of the inner lever 20 through the opening of the shaft holder 12 toward the back side. In addition, the inner lever rack 34 has rack teeth along a portion of the side facing the bottom end of the shaft holder 12. The rack teeth of the inner lever rack 34 are adapted to mesh with the pinion 36 positioned under the inner lever rack 34, as shown in FIG. 4. As a result, the pinion 36 will move the inner lever 20 toward the center of the support shaft 14 by rotating at a first rotational direction and will move the inner lever 20 toward the shaft holder 12, i.e., away from the center of the support shaft 14, by rotating at a second rotational direction, opposite to the first. The pinion is rotatably coupled to the inner lever rack 34 and the outer lever rack 38 at diametrically opposite ends and is substantially positioned inside the back side of the shaft holder 12. In the preferred embodiment, the inner lever rack 34 and the inner lever 20 are integrally molded with plastic materials. In other embodiments, the inner lever rack 34 and the inner lever 20 may be formed separately, or they may be made of different materials.

As noted, the rack and pinion mechanism 16 further comprises the outer lever rack 38 slidably positioned within the support shaft 14 through the opening of the shaft holder 12. Furthermore, a portion of the outer lever rack 38 is positioned between the lever support 52 and the inner surface of the support shaft 14. The outer lever rack 38 is approximately 5.75 inches long, which is considerably longer than the inner lever rack 34, thereby an outer end of the outer lever rack 38 is adapted to be coupled to the outer lever 18. Similar to the inner lever rack 34, the outer lever rack 38 also has rack teeth along a portion of the side facing the pinion 36. As a result, the inner lever rack 34 and the outer lever rack 38 respectively mesh with the pinion 36 at diametrically opposite sides of the pinion 36. Accordingly, the pinion 36 will move the outer lever 18 toward the center of the support shaft 14 by rotating at the first rotational direction and will move the outer lever 18 toward the open end of the support shaft 14, i.e., away from the center of the support shaft 14, by rotating at the second rotational direction, opposite to the first.

The outer lever 18 has a brick shape top section 40. In the preferred embodiment, the top section 40 has six square holes arranged in two rows, three in each row, along a longer side of the top section 40, as shown in FIG. 2*a*. In alternative embodiments, the shape of the top section 40, the number of the holes, the shape of the holes, or the arrangement of the holes could all be modified. The top section 40 of the outer lever 18 has a dimension of approximately one inch high, 0.4 inches wide, and 0.74 inches thick. Referring to FIG. 4, the outer lever 18 also has a neck section 42 extending downward from the bottom of the top section 40. The neck section 42 is thinner than the top section 40 and is adapted to be inserted into the outer opening slot 30, as shown in FIG. 2. Moreover, the neck section 42 is approximately 0.45 inches long, thereby it could contact the outer lever rack 38 at the bottom. The bottom end of the neck section 42 has a cam shape. Correspondingly, the outer end of the outer lever rack 38 has a vertical wall 48 and a front extension 50. The front extension 50 has a cam section 58 and a front wall 46, wherein the cam shape bottom of the neck section 42 is adapted to directly contact the cam section 58 of the front extension 50. The front wall 46 has a generally round shape face having an outer diameter slightly smaller than the inner diameter of the support shaft 14. In addition, a vertical slot 60 extending from the top of the front wall 46 toward the bottom half is formed. The vertical slot 60 is approximately 0.46 inches long and 0.15 inches wide. The width of the vertical slot 60 is slightly larger than the thickness of the neck section 42 of the outer lever 18, thereby a portion of the neck section 42 could move freely along the vertical slot 60. Furthermore, the neck section 42 is pivotally coupled to the front wall 46 through a pivot pin 56. Thus, the outer lever 18 could pivotally rotate against the cam section 58 of the front extension 50 through the pivot pin 56.

The bottom inner surface of the support shaft 14 has a groove 54 extending from near the outer end inward of approximately 2 inches. The bottom of the front extension 50 is situated on the groove 54, whereby the front extension 50 is confined to move within the support shaft 14 along the groove 54. In the preferred embodiment, the outer lever 18 is adapted to swing approximately 90° between a substantially vertical position and a substantially horizontal position, as shown respectively in FIGS. 2*b* and 2*c*. Since the top section 40 is thicker than the width of the outer opening slot 30, the outer lever 18 is capable of being positioned horizontally only when it is at the outer end of the support shaft 14, FIG. 2*c*. In addition, a contacting block 44 is securely mounted on a front surface of the vertical wall 48 facing the outer lever 18. The contacting block 44 is positioned at the top of the front surface of the vertical wall 48, whereby the top surface of the contacting block 44 is substantially flush with the top surface of the vertical wall 48. The contacting block 44 functions as a stop for the outer lever 18 when the outer lever reaches its vertical position, as shown in FIG. 4.

To install a printing medium roll on the support shaft 14, the outer lever 18 has to be initially positioned horizontally at the outer end of the outer opening slot 30, as shown in FIG. 2*c*. The user may thereafter insert the printing medium roll over the outer lever 18 and onto the support shaft 14. After the printing medium roll is securely mounted on the support shaft 14, the outer lever 18 shall be swung 90° to be positioned vertically. Thus, the printing medium roll is securely trapped between the inner and outer levers 20, 18 and will not accidentally fall off the support shaft 14. The lengths of the inner lever rack 34 and the outer lever rack 38 are carefully selected, thereby the inner lever 20 and the outer lever 18 are approximately equally distanced from the center of the support shaft 14, or from a center point defined by opposite ends of the support frame 3. Moreover, the inner lever rack 34 and the outer lever rack 38 are diametrically meshed with the pinion 36. As a result, when one of them is moved toward or away from the center of the support shaft 14, the other one will be correspondingly moved toward or away form the center with approximately equal distance. By having this rack and pinion arrangement, the printing medium roll mounted on the support shaft 14 will be approximately center-adjusted with respect to the support shaft 14 or to the support frame 3.

From the foregoing, it will be appreciated that, although specific embodiments of the invention have been described herein for purposes of illustration, various modifications may be made by persons skilled in the art without deviating from the spirit and/or scope of the invention. Particularly, all dimensions mentioned above may be adjusted accordingly based on specific needs of each particular device which the integrated medium roll support is to be incorporated therein. Moreover, the rack and pinion medium roll support may be made from any suitable materials. The shaft holder, the inner lever and the outer lever could have shapes different from the shapes disclosed in the preferred embodiment.

What is claimed is:

1. A print media roll support assembly, comprising:

a shaft holder having a top step disposed substantially over a base step at one side and a reverse step at an opposite side;

a shaft securely coupled at one end to said top step of said shaft holder for supporting a print media roll;

a rack and pinion mechanism operatively coupled to said shaft and said shaft holder;

a first lever coupled to a first rack of said rack and pinion mechanism and adapted to slide within said shaft; and a second lever coupled to a second rack of said rack and pinion mechanism and adapted to slide within said shaft opposite said first lever and to rotate from a position substantially parallel to said top step to a position substantially parallel to said shaft to allow mounting of a print media roll on said shaft, said coupled first and second levers adapted to center adjust a print media roll mounted on said shaft.

2. The print media roll support assembly of claim 1, said shaft holder further comprising at least one aperture for use in securely mounting said shaft holder onto a receiving device, said shaft being cantilevered inside an internal compartment of said receiving device.

3. A print media roll support assembly, comprising:

a shaft holder;

a generally tubular shaft coupled at one end to said shaft holder for supporting a print media roll in a cantilevered fashion, said shaft having a first slot disposed proximate said coupled end of said shaft and a second slot disposed opposite said first slot at another end of said shaft;

a rack and pinion mechanism operatively coupled to said shaft and said shaft holder, said rack and pinion mechanism comprising a pinion rotatably coupled to said shaft holder and first and second racks operatively coupled to said rotatably coupled pinion at diametrically opposite ends of said pinion;

a first lever coupled to said first rack and adapted to slide within said first slot of said shaft; and a second lever coupled to said second rack and adapted to slide within said second slot of said shaft and to rotate within said second slot from a position substantially parallel to said shaft holder to a position substantially parallel to said shaft to allow mounting of a print media roll on said shaft, said coupled first and second levers adapted to center adjust a print media roll mounted on said shaft.

4. The print media roll support assembly of claim 3, wherein said first lever comprises a substantially fan-shaped top section disposed over said first slot and a substantially L-shaped bottom section coupled to said fan-shaped top section within said first slot, said first rack coupled to a back side of said fan-shaped top section and having a set of teeth at a bottom side adapted to mesh with a corresponding set of teeth on said pinion.

5. The print media roll support assembly of claim 3, wherein said second lever comprises a top section and a neck section coupled to said top section and having a cam-shaped bottom adapted for sliding within said second slot, said neck section of said second lever pivotally coupled to said second rack at a front extension of said second rack, said second rack having a set of teeth at a top side adapted to mesh with a corresponding set of teeth on said pinion at diametrically opposite ends of said pinion.

6. The print media roll support assembly of claim 5, wherein said front extension of said second rack comprises a cam section, said cam-shaped bottom of said neck section being adapted to rotate against said cam section of said front extension.

7. The print media roll support assembly of claim 6, further comprising a substantially vertical block coupled to a first end of said second rack over said front extension of said second rack for stopping said rotating second lever in a position substantially parallel to said shaft holder.

8. The print media roll support assembly of claim 7, wherein said front extension of said second rack further comprises a front wall of generally circular shape and having a vertical slot adapted to allow a portion of said neck section of said second lever to move freely along said vertical slot.

9. The print media roll support assembly of claim 3, wherein each of said coupled first and second levers is substantially equally spaced from a pre-defined center point on said shaft.

10. A print media roll support device, comprising:

(a) a shaft having a first slot disposed at one end of said shaft and a second slot disposed opposite said first slot at another end of said shaft;

(b) a rack and pinion mechanism operatively coupled to said shaft;

(c) a first lever coupled to a first rack of said rack and pinion mechanism and adapted to slide within said first slot of said shaft; and (d) a second lever coupled to a second rack of said rack and pinion mechanism and adapted to slide within said second slot of said shaft and to rotate within said second slot from a position substantially perpendicular to said shaft to a position substantially parallel to said shaft to allow mounting of a print media roll on said shaft, said coupled first and second levers adapted to center adjust a print media roll mounted on said shaft.

11. The print media roll support device of claim 10, wherein said first lever comprises a substantially fan-shaped top section disposed over said first slot and a substantially L-shaped bottom section coupled to said fan-shaped top section within said first slot, said first rack coupled to a back side of said fan-shaped top section and having a set of teeth at a bottom side adapted to mesh with a corresponding set of teeth on a pinion of said rack and pinion mechanism.

12. The print media roll support device of claim 10, wherein said second lever comprises a top section and a neck section coupled to said top section and having a cam-shaped bottom adapted for sliding within said second slot, said neck section pivotally coupled to said second rack at a front extension of said second rack, said second rack having a set of teeth at a top side adapted to mesh with a corresponding set of teeth on a pinion of said rack and pinion mechanism at diametrically opposite ends of said pinion.

13. The print media roll support device of claim 12, wherein said front extension of said second rack comprises a cam section, said cam-shaped bottom of said neck section adapted to rotate against said cam section of said front extension.

14. The print media roll support device of claim 12, further comprising a substantially vertical block coupled to a first end of said second rack over said front extension of said second rack for stopping said rotating second lever in a position substantially perpendicular to said shaft.

15. The print media roll support device of claim 14, wherein said front extension of said second rack further comprises a front wall of generally circular shape and having a vertical slot adapted to allow a portion of said neck section of said second lever to move freely along said vertical slot.

16. The print media roll support device of claim 10, wherein each of said coupled first and second levers is substantially equally spaced from a pre-defined center point on said shaft.

17. The print media roll support device of claim 10, wherein said shaft is of a generally tubular shape.

* * * * *